US010760871B2

(12) United States Patent
Smith

(10) Patent No.: US 10,760,871 B2
(45) Date of Patent: Sep. 1, 2020

(54) LIQUID DISPENSING SQUIRT DEVICE

(71) Applicant: Stone Smith, Crefton (CA)

(72) Inventor: Stone Smith, Crefton (CA)

( * ) Notice: Subject to any disclaimer, the term of this patent is extended or adjusted under 35 U.S.C. 154(b) by 0 days.

(21) Appl. No.: 15/825,198

(22) Filed: Nov. 29, 2017

(65) Prior Publication Data

US 2018/0224238 A1 Aug. 9, 2018

Related U.S. Application Data

(60) Provisional application No. 62/455,779, filed on Feb. 7, 2017.

(51) Int. Cl.

| | |
|---|---|
| ***B65D 83/16*** | (2006.01) |
| ***F41B 9/00*** | (2006.01) |
| *B65D 1/16* | (2006.01) |

(52) U.S. Cl.

CPC ..... *F41B 9/0015* (2013.01); *F41B 9/0065* (2013.01); *F41B 9/0071* (2013.01); *B65D 1/165* (2013.01)

(58) Field of Classification Search

CPC .... F41B 9/0015; F41B 9/0065; F41B 9/0071; B65D 1/165; B65D 83/267; B65D 83/202; B65D 83/386; B65D 83/22; F41H 9/10

USPC ..... 222/5, 162, 325, 79, 80–91

See application file for complete search history.

(56) References Cited

U.S. PATENT DOCUMENTS

| | | | | | |
|---|---|---|---|---|---|
| 2,792,969 | A * | 5/1957 | Anderson | F16N 3/08 | 222/383.1 |
| 3,119,561 | A * | 1/1964 | Wilson | A61M 11/00 | 222/399 |
| 3,228,565 | A * | 1/1966 | Stanzel | F41H 9/10 | 222/160 |
| 3,443,725 | A * | 5/1969 | Lawhorn | B05C 17/01 | 222/79 |
| 3,705,666 | A * | 12/1972 | Nelson | B05C 21/00 | 222/385 |
| 3,841,526 | A * | 10/1974 | Haskins | F41B 9/0087 | 222/79 |
| 3,967,757 | A * | 7/1976 | Fegley | B65D 83/267 | 222/5 |
| 4,446,990 | A * | 5/1984 | Stevenson | F41H 9/10 | 222/398 |
| 4,685,595 | A * | 8/1987 | Segatz | B05C 17/0123 | 222/326 |
| 5,897,026 | A * | 4/1999 | Vester | F41H 9/10 | 222/402.11 |
| 5,901,723 | A * | 5/1999 | Ames | A45B 3/14 | 135/66 |
| 6,305,619 | B1 * | 10/2001 | Thurn | A01M 21/043 | 222/175 |
| 6,405,943 | B1 * | 6/2002 | Stadnyk | A47L 1/06 | 222/5 |
| 7,188,753 | B2 * | 3/2007 | Campbell | B05C 17/0146 | 222/389 |

(Continued)

*Primary Examiner* — Charles P Cheyney

(74) *Attorney, Agent, or Firm* — IPS Legal Group, P.A.

(57) ABSTRACT

A liquid dispensing squirt device comprises a handle member, a barrel/loading member, and a spray nozzle member. The barrel/loading member connects to the top portion of the handle member, and contains an access hatch where the carbonated beverage is held. The liquid from the carbonated beverage can is dispensed through the spray nozzle with the can is pierced.

6 Claims, 3 Drawing Sheets

(56) References Cited

U.S. PATENT DOCUMENTS 8,544,686 B2 * 10/2013 Williams ..... B05B 11/02
222/105

* cited by examiner

LIQUID DISPENSING SQUIRT DEVICE

CROSS-REFERENCE TO RELATED APPLICATION

This application claims priority to U.S. Provisional Application No. 62/455,779 filed on Feb. 7, 2017, the disclosure of which, including any materials incorporated by reference therein, is incorporated herein by reference in its entirety.

TECHNICAL FIELD

The present invention relates generally to liquid dispensing guns, and more specifically a liquid dispensing squirt device that releases an intermittent, continuous, or non-continuous stream of pressurized liquid from a can containing a carbonated beverage.

BACKGROUND

Current liquid dispensing guns are equipped to dispense water. While water guns are great for fun events, the water guns cannot be easily used to dispense carbonated drinks. The carbonation in such drinks, if used in a liquid dispensing squirt device, would increase both the range of the toy and the user's enjoyment. Therefore, a need exists for a liquid dispensing squirt gun that dispenses carbonated beverages.

Various attempts to meet this need have been made. One such attempt can be seen with respect to U.S. Pat. No. 4,591,071, incorporated by reference in its entirety herein, which generally discloses a squirt gun. While this disclosure does provide for a pressurized stream of water, it does not provide for a system that can utilize carbonated beverages.

Another attempt can be seen with respect to U.S. Pat. No. 1,907,839, incorporated by reference in its entirety herein, which generally discloses a revolver-shaped squirt gun. While this disclosure does provide for simple design, it also is unable to utilize carbonated beverages.

Yet another attempt can be seen with respect to U.S. Pat. No. 1,744,208, incorporated by reference in its entirety herein, which generally discloses a compression-spray device. While this patent does disclose a pressurized spray system, it is not adequately configured for use with a carbonated can nor is it suitable for recreational use.

Various attempts have been made to solve the problems which may be found in the related art but have thus far been unsuccessful. A need exists for a new liquid dispensing squirt device to avoid the above-mentioned problems.

SUMMARY OF THE INVENTION

It is to be understood that in the present disclosure, all embodiments are provided as illustrative and non-limiting representatives of many possible embodiments. In addition, the terms "is," "can," "will," and the like are herein used as synonyms for and interchangeable with terms such as "may," "may provide for," and "it is contemplated that the present invention may" and so forth.

Furthermore, all elements listed by name, such as a gun, can, trigger, etc., are herein meant to include or encompass all equivalents for such elements. For example, in addition to a "can" any container containing a carbonated beverage is also contemplated by the present invention. Or, in addition to a carbonated beverage, any pressurized container of liquid is contemplated. Such equivalents are contemplated for each element named in its particular herein.

The present invention relates to a liquid dispensing squirt device that overcomes the deficiencies of the prior art. It is contemplated that the present invention may provide a gun-shaped toy that shoots carbonated liquid, generally for recreational purposes.

For purposes of summarizing, certain aspects, advantages, and novel features of the present invention are provided herein. It is to be understood that not all such aspects, advantages, or novel features may be provided in any one particular embodiment. Thus, the disclosed subject matter may be embodied or carried out in a manner that achieves or optimizes one aspect, advantage, or novel feature or group of features without achieving all aspects, advantages, or novel features as may be taught or suggested.

In view of the foregoing disadvantages inherent in the known art, the present invention provides a novel liquid dispensing squirt device. The general purpose of the present invention, which will be described subsequently in greater detail, is to provide a toy that can shoot or otherwise propel carbonated liquid from inside a can. The features of the invention which are believed to be novel are particularly pointed out and distinctly claimed in the concluding portion of the specification. These and other features, aspects, and advantages of the present invention will become better understood with reference to the following drawings and detailed description.

In some embodiments, the present invention may comprise a handle member, a barrel/loading member, and a spray nozzle member. The barrel/loading member may connect to the top portion of the handle member, and may contain an access hatch wherein the carbonated beverage is held.

In some embodiments, the user may place a carbonated beverage can into the present invention's barrel/loading member such that the bottom of the carbonated beverage can faces the rear end of the barrel/loading member. A user may then apply pressure to the top of the can via a pushing and locking mechanism from the rear end of the barrel/loading member, which presses the can against a pressure-rated piercing needle, retracting safety shroud, and silicon sealing ring mechanism. Once secured, the user can shake the liquid dispensing squirt gun to add additional pressure within the carbonated beverage can. Using the trigger mechanism located on the handle member, the contents may be released from the can, through the piercing needle and seal assembly, and thereby may pass outward through the spray nozzle member.

The unique features of the present invention may provide the following benefits for one or more consumers: it may provide for the safe and functional discharge of pressurized contents from an carbonated beverage can.

BRIEF DESCRIPTION OF THE DRAWINGS

These and other features, aspects and advantages of the present invention will become better understood with regard to the following description, appended claims, and accompanying figures where:

DETAILED DESCRIPTION

Figure 1:
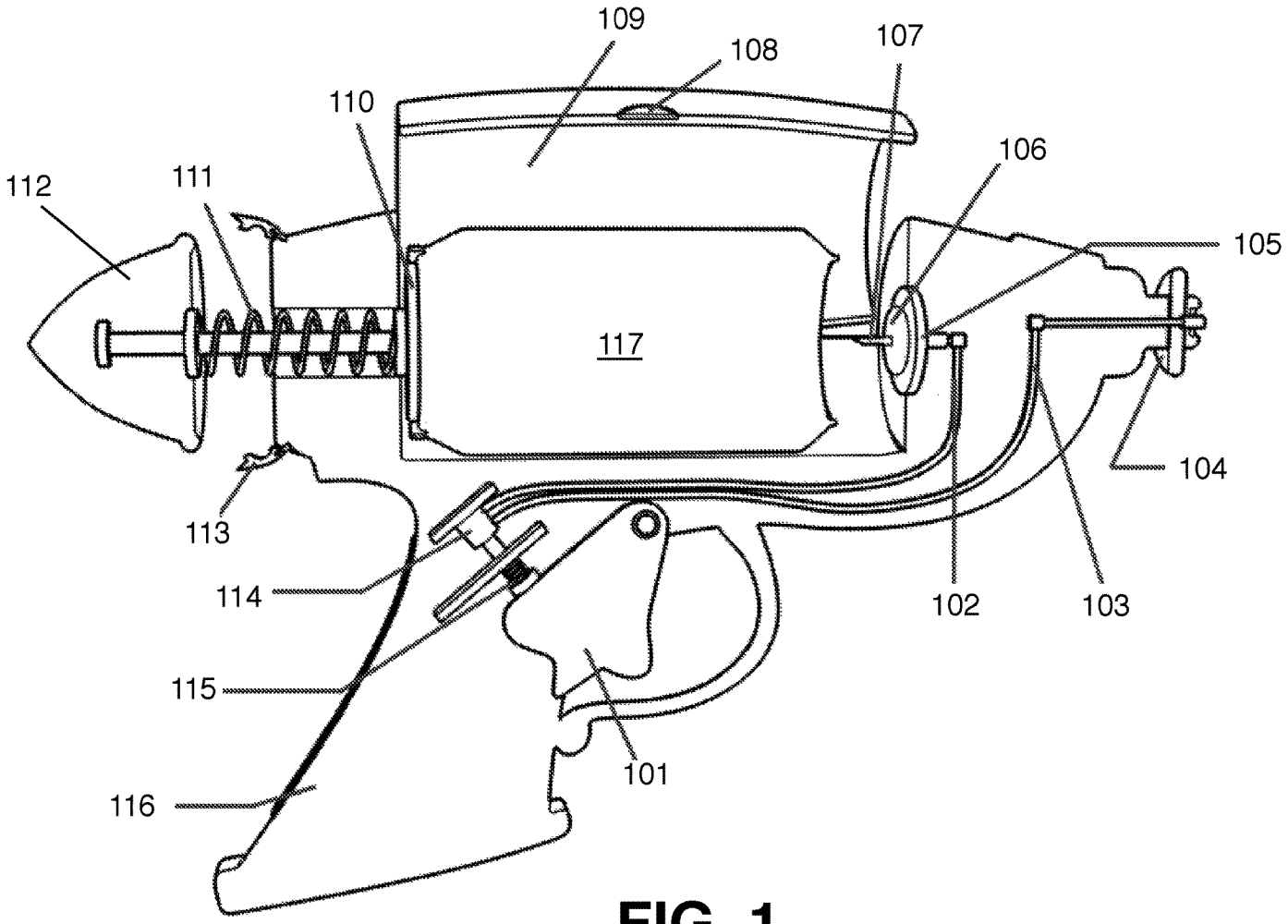
FIG. 1 shows a side view of a liquid dispensing squirt device in accordance with one embodiment of the invention.

The present invention overcomes the limitations of the prior art by providing a new and more effective liquid dispensing squirt device.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any embodiment or element of an embodiment disclosed in this disclosure will be determined by its intended use.

It is to be understood that the drawings and the associated descriptions are provided to illustrate potential embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

Throughout the drawings, reference numbers are re-used to indicate correspondence between referenced elements. In addition, the first digit of each reference number indicates the figure where the element first appears.

As used in this disclosure, except where the context requires otherwise, the term "comprise" and variations of the term, such as "comprising", "comprises" and "comprised" are not intended to exclude other additives, components, integers or steps.

In the following description, specific details are given to provide a thorough understanding of the embodiments. However, it will be understood by one of ordinary skill in the art that the embodiments may be practiced without these specific detail. Well known features, elements or techniques may not be shown in detail in order not to obscure the embodiments.

In some embodiments, the present invention may comprise a substantially hollow housing having at least one chamber and at least one access hatch, wherein the at least one access hatch is hingedly connected to the housing, and wherein the at least one access hatch is configured to cover the at least one chamber, and wherein the at least one chamber is configured to removably receive at least one carbonated beverage can. The present invention may further comprise a spray pattern adjust element rotatably connected to an end of the housing.

In some embodiments, the present invention may provide for at least one firing mechanism disposed along the housing on the inside of the at least one chamber. The firing mechanism may comprise a) a first tension spring, wherein the first tension spring encircles a rod; b) a pressure plate fixedly connected to the tension spring, wherein the pressure plate is configured to receive a second end of a carbonated beverage can; c) a piercing needle, wherein the piercing needle is configured to pierce a first end of the carbonated beverage can; d) a silicon sealing ring fixedly connected to the piercing needle; e) a support structure element fixedly connected to the silicon sealing ring; f) an outgoing pressure line configured to receive the contents of the carbonated beverage can when the carbonated beverage can is pierced by the piercing needle; g) a second tension spring connected to a piston value, wherein the piston valve is configured to receive the contents of the carbonated beverage can from the outgoing pressure line; and h) a return pressure line connected to the piston valve and the spray pattern adjust element, wherein the return pressure line is configured to receive the contents of the carbonated beverage can from the piston valve.

In some embodiments, the present invention may further comprise at least one latch attached to the at least one access hatch, wherein the at least one latch is configured to removably secure the at least one access hatch against the housing; at least one stock fixedly connected to the housing; at least one lock system rotatably connected to the first tension spring, wherein the at least one lock system is configured to rotate between a first position and a second position, and wherein when the at least one lock system is rotated to the second position, the first tension spring pushes the pressure plate against the carbonated beverage can such that the piercing needle pierces the first end of the carbonated beverage can; and at least one trigger disposed on the at least one stock, the trigger having a first position and a second position, wherein the trigger is movably connected to the piston valve, and wherein when the trigger is in the first position, the trigger causes a change in the piston valve such that the contents of the carbonated beverage can are allowed to flow from the outgoing pressure line through the piston valve, through the return pressure line, and through the spray pattern adjust element.

In some embodiments, the present invention's housing may be shaped as a pistol, and the at least one stock may be a handle. In some embodiments, the present invention's housing may be shaped as a rifle, the at least one stock may be a butt stock, and the at least one lock system is shaped as a bolt action lever.

Turning attention to FIG. 1, a side view of a liquid dispensing squirt device in accordance with one embodiment of the invention is shown. In the embodiment depicted, a viewer may perceive trigger 101, outgoing pressure line 102, return pressure line 103, spray pattern adjust element 104, gun body support structure 105, silicon sealing ring 106, piercing needle 107, latch 108, access hatch 109, pressure plate 110, first tension spring 111, rear housing 112, lock system 113, piston valve 114, second tension spring 115, stock 116, and carbonated beverage can 117.

In some embodiments, outgoing pressure line 102 and return pressure line 103 may vary, such that outgoing pressure line 102 and return pressure line 103 may be longer or shorter, or of greater or lesser diameter. Outgoing pressure line 102 and return pressure line 103 may be also made from a thick elastomer or other material selected for durability against corrosive liquids.

In some embodiments, silicon sealing ring 106 and piercing needle 107 may be configured such that, when piercing needle 107 punctures carbonated beverage can 117, silicon sealing ring 106 may seal against carbonated beverage can 117 and enable the contents of carbonated beverage can 117 to pass entirely or substantially into outgoing pressure line 102 without leaking or spraying within or onto the present invention or a user.

In some embodiments, spray pattern adjust element 104 may be a spray nozzle, and may have any number of spray options known in the spray nozzle art, including but not limited to mist, spray, and stream.

Figure 2:
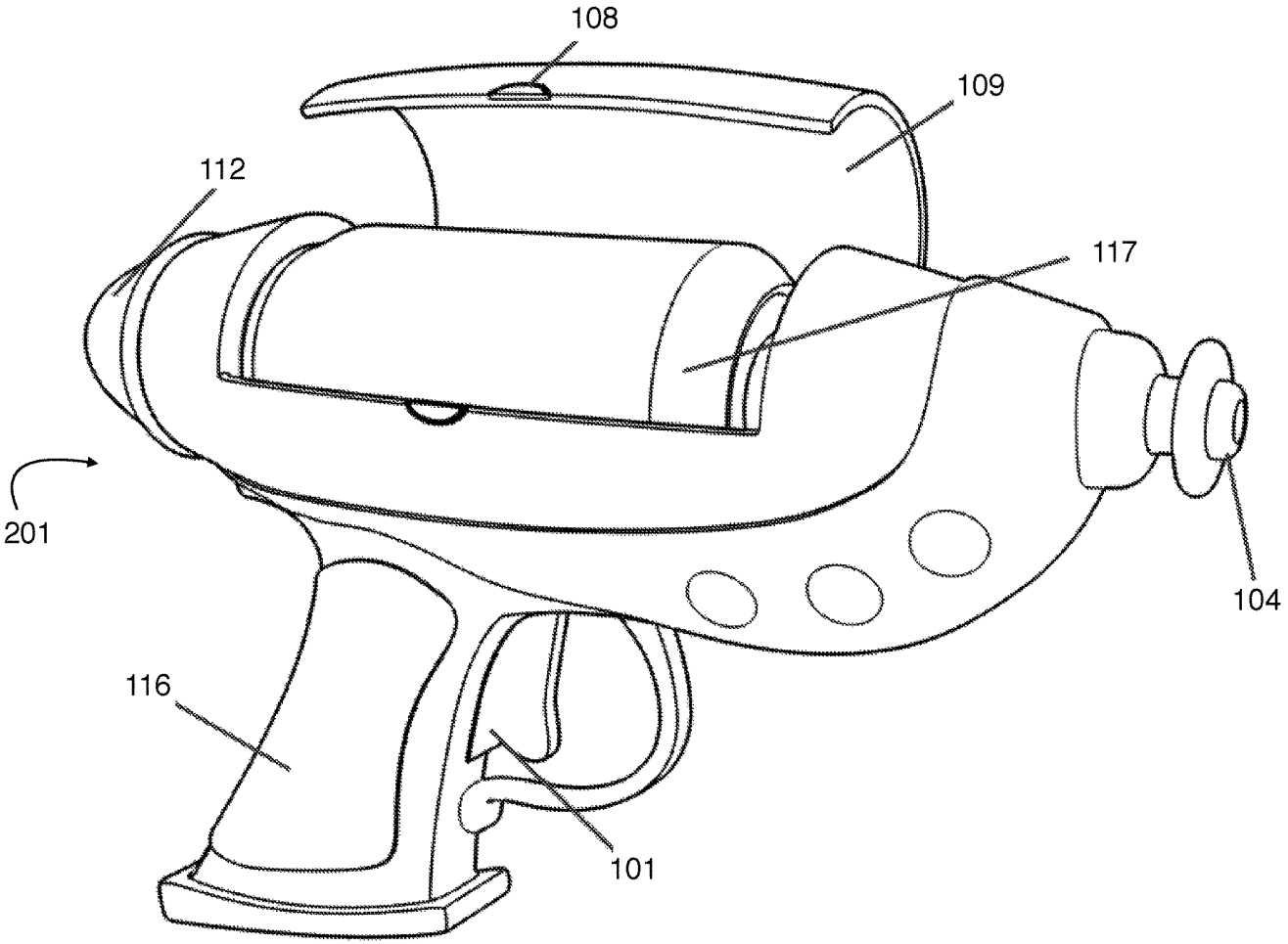
FIG. 2 shows a side-perspective view of a liquid dispensing squirt device in accordance with one embodiment of the invention.

With respect to FIG. 2, a side-perspective view of a liquid dispensing squirt device in accordance with one embodiment of the invention is shown. In the embodiment depicted, a viewer may perceive housing 201, along with trigger 101, spray pattern adjust element 104, latch 108, access hatch 109, rear housing 112, stock 116, and carbonated beverage can 117. In the embodiment disclosed in FIG. 2, the present invention's housing 201 is shaped as a pistol and stock 116 is shaped as a pistol handle.

Figure 3:
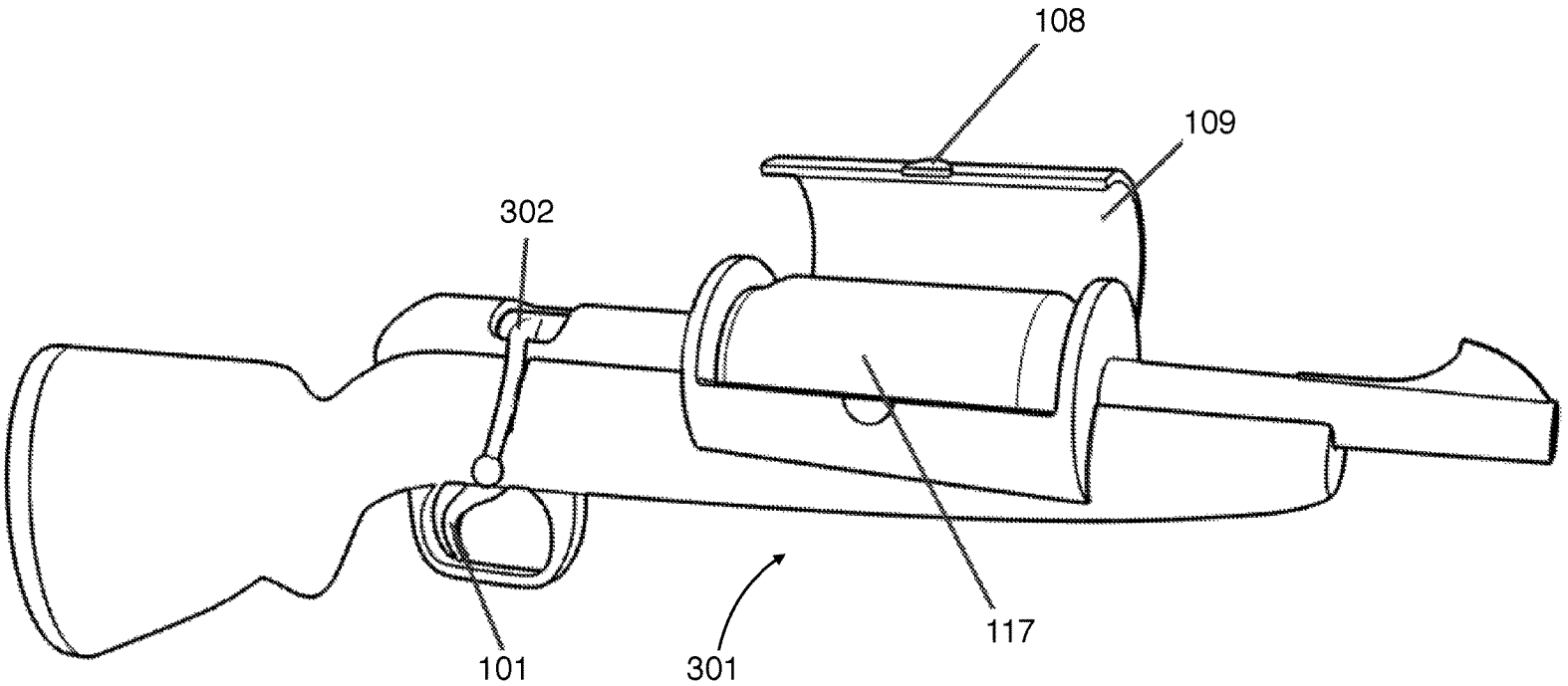
FIG. 3 shows a side-perspective view of an additional embodiment of a liquid dispensing squirt device in accordance with one embodiment of the invention.

With respect to FIG. 3, a side-perspective view of an additional embodiment of a liquid dispensing squirt device in accordance with one embodiment of the invention is shown. In the embodiment depicted, a viewer may perceive second housing 301 and bolt action lever 302, as well as perceive trigger 101, latch 108, access hatch 109, and carbonated beverage can 117. In the embodiment disclosed in FIG. 4, the present invention's second housing 301 is shaped as a rifle, stock 116 is shaped as a butt stock, and lock system 113 is shaped as bolt action lever 302.

CONCLUSIONS, RAMIFICATIONS, AND SCOPE

Although the present invention has been described with a degree of particularity, it is understood that the present disclosure has been made by way of example and that other versions are possible. As various changes could be made in the above description without departing from the scope of the invention, it is intended that all matter contained in the above description or shown in the accompanying drawings shall be illustrative and not used in a limiting sense. The spirit and scope of the appended claims should not be limited to the description of the preferred versions contained in this disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. § 112.

While the liquid dispensing squirt device generally described herein has been disclosed in connection with a number of embodiments shown and described in detail, various modifications should be readily apparent to those of skill in the art.

What is claimed is:

1. A liquid dispensing squirt device, comprising:

a substantially hollow housing having at least one chamber and at least one access hatch, wherein the at least one access hatch is hingedly connected to the housing, and wherein the at least one access hatch is configured to cover the at least one chamber, and wherein the at least one chamber is configured to removably receive at least one carbonated beverage can;

a spray pattern adjust element rotatably connected to an end of the housing;

at least one firing mechanism disposed along the housing inside the at least one chamber, the at least one firing mechanism comprising:

a) a first tension spring, wherein the first tension spring encircles a rod;

b) a pressure plate fixedly connected to the tension spring, wherein the pressure plate is configured to receive a second end of a carbonated beverage can;

c) a piercing needle, wherein the piercing needle is configured to pierce a first end of the carbonated beverage can;

d) a silicon sealing ring fixedly connected to the piercing needle;

e) a support structure element fixedly connected to the silicon sealing ring;

f) an outgoing pressure line configured to receive the contents of the carbonated beverage can when the carbonated beverage can is pierced by the piercing needle;

g) a second tension spring connected to a piston valve, wherein the piston valve is configured to receive the contents of the carbonated beverage can from the outgoing pressure line; and h) a return pressure line connected to the piston valve and the spray pattern adjust element, wherein the return pressure line is configured to receive the contents of the carbonated beverage can from the piston valve;

at least one latch attached to the at least one access hatch, wherein the at least one latch is configured to removably secure the at least one access hatch against the housing;

at least one stock fixedly connected to the housing;

at least one lock system rotatably connected to the first tension spring, wherein the at least one lock system is configured to rotate between a first position and a second position, and wherein when the at least one lock system is rotated to the second position, the first tension spring pushes the pressure plate against the carbonated beverage can such that the piercing needle pierces the first end of the carbonated beverage can; and at least one trigger disposed on the at least one stock, the trigger having a first position and a second position, wherein the trigger is movably connected to the piston valve, and wherein when the trigger is in the first position, the trigger causes a change in the piston valve such that the contents of the carbonated beverage can are allowed to flow from the outgoing pressure line through the piston valve, through the return pressure line, and through the spray pattern adjust element.

2. The liquid dispensing squirt device of claim 1, wherein the housing is shaped as a pistol.

3. The liquid dispensing squirt device of claim 2, wherein the at least one stock is a handle.

4. The liquid dispensing squirt device of claim 1, wherein the housing is shaped as a rifle.

5. The liquid dispensing squirt device of claim 4, wherein the at least one stock is a butt stock.

6. The liquid dispensing squirt device of claim 4, wherein the at least one lock system is shaped as a bolt action lever.

* * * * *